United States Patent [19]

Jones

[11] 4,007,904

[45] Feb. 15, 1977

[54] ANNULAR BLOWOUT PREVENTER

[75] Inventor: Marvin R. Jones, Houston, Tex.

[73] Assignee: Cameron Iron Works, Inc., Houston, Tex.

[22] Filed: Mar. 28, 1975

[21] Appl. No.: 563,194

[52] U.S. Cl. ..... 251/1 B; 251/5; 277/127; 277/235 R

[51] Int. Cl.[2] ..... E21B 33/06

[58] Field of Search ..... 251/1 B, 5; 277/73, 277/127, 128, 235 R; 166/84

[56] References Cited

UNITED STATES PATENTS

| | | | |
|---|---|---|---|
| 3,090,591 | 5/1963 | Clarkson | 251/5 |
| 3,492,007 | 1/1970 | Jones | 166/84 X |
| 3,572,627 | 3/1971 | Jones | 251/1 B |
| 3,572,628 | 3/1971 | Jones | 251/1 B |
| 3,614,111 | 10/1971 | Regan | 251/1 B X |
| 3,737,139 | 6/1973 | Watts | 251/1 B |

*Primary Examiner*—Martin P. Schwadron
*Assistant Examiner*—Richard Gerard
*Attorney, Agent, or Firm*—W. F. Hyer; Marvin B. Eickenroht

[57] ABSTRACT

There is disclosed an annular blowout preventer wherein a packer, received within a recess about a bore through the preventer housing, is adapted to be contracted by means of a piston having an annulus of resilient material movable inwardly within a chamber surrounding the recess and divided therefrom by a wall of the housing, and a disc-shaped member of resilient material extending through and sealably slidable within a slot in the wall to transmit the inward movement of the piston to the packer.

37 Claims, 11 Drawing Figures

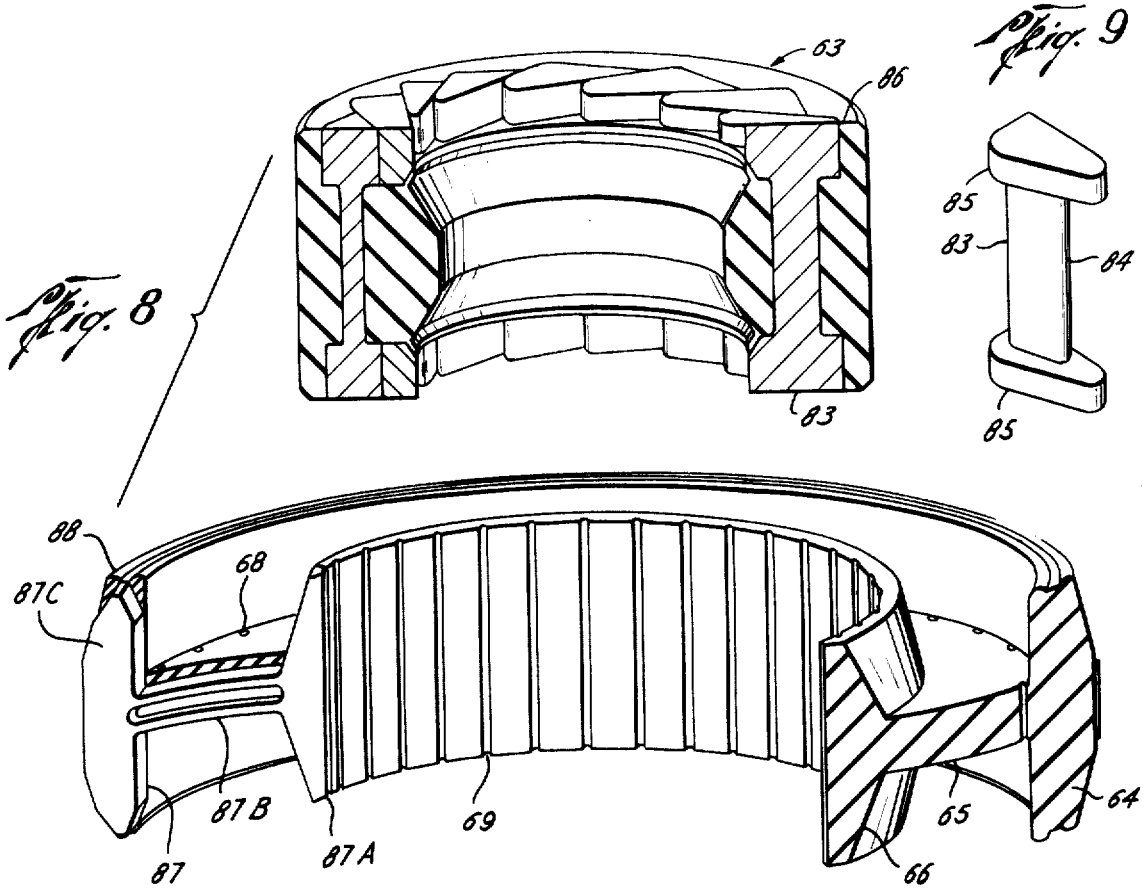
Fig. 8
Fig. 9
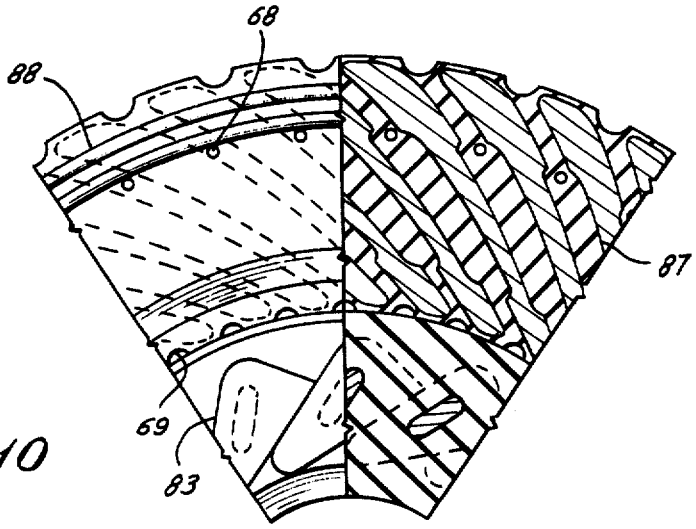
Fig. 10

ANNULAR BLOWOUT PREVENTER

This invention relates to improvements in an annular blowout preventer wherein a packer comprising a massive annulus of resilient material is mounted within a recess about a bore through a preventer housing in position to be contracted into sealing engagement about an object in the bore or upon itself when the bore is empty.

In an early preventer of this type shown and described in U.S. Pat. No. 2,609,836, a conically shaped outer surface of the packer is seated upon a similarly shaped upper surface of an annular piston which is vertically reciprocable within the housing so that, as the piston is moved upwardly, its upper surface slides over the outer surface of the packer to seal thereabout and contract the packer. The requirement that the housing be high enough to permit the required vertical stroke of the piston is often a problem since headroom is at a premium in the environment in which blowout preventers are used. Also, since the piston must slide over a substantial portion of the outer side of the annulus, it requires considerable operating force, which adds to the size and cost of the preventer.

U.S. Pat. Nos. 3,572,627 and 3,572,628 show and describe a subsequent preventer of this type in which the packer is contracted by means of arcuate segments disposed about the packer within the recess of the housing. The segments are in turn connected to pistons radially reciprocable within cylinders formed in the outer side of the housing by means of rods extending sealably through holes in walls of the housing separating the recess from the cylinders. As noted in such patents, the housings of preventers of this construction are much shorter than those of the earlier preventers. Furthermore, since there is only a small amount of relative sliding between the arcuate segments and the packer these preventers have lower operating power requirements. However, such preventers are relatively expensive to manufacture, due primarily to the need to form a cylinder bore in the housing for each segment-actuating piston. Also, the strokes of the pistons, even though relatively short, require a housing having an outer diameter which may be greater than desired.

In other prior preventers of this type, such as those shown in U.S. Pat. Nos. 3,492,007 and 3,737,139, the packer is contracted by means of an inflatable bag disposed about the packer within the recess in the bore of the preventer housing. Such bags eliminate the need to form radially extending cylinders in the housing, and thus require only a small amount of radial space about the packer. However, they extend over the entire height of the outer circumference of the packer. Thus, there is a large area over which well pressure in the bore of the preventer body is effective to create a large force which must be overcome by operating fluid behind the bag in urging the annulus to contracted position.

In the packers of prior annular preventers the annulus of resilient material is reinforced by means of a circular series of rigid inserts bonded thereto and embedded therein and comprising ribs having flanges on their opposite ends adjacent the ends of the annulus. In the packer of the preventer shown in U.S. Pat. Nos. 3,572,627 and 3,572,628, the sides of the ribs of each insert lie approximately within planes of least strain in the resilient material, as the packer is contracted, so as to reduce the tendency of the bond between such sides and the material to be broken. However, a closer approximation is desirable, particularly for inserts of greater radial extent.

An object of this invention is to provide an annular preventer which is of relatively short height and small radial extent, relatively inexpensive to manufacture, and of such construction that the force by which it is moved to contracted position is opposed by only a small force due to well pressure in the bore of the preventer body.

A further object is to provide such a preventer in which the packer and the fluid operated means by which it is caused to contract may be easily and readily replaced as a unit or in which the packer may be separately replaced without disturbing the fluid operator.

A still further object is to provide a packer for a preventer of this type having rigid reinforcing members whose opposite entire sides lie more nearly on surfaces of least strain.

These and other objects are accomplished, in accordance with the illustrated embodiments of the invention, by a blowout preventer of this type in which the packer is contracted by a piston comprising a contractible annulus of resilient material which is sealably slidable within a chamber about the packer recess in the housing, and a means which is sealably slidable through a wall of the housing dividing the recess from the chamber for transmitting inward movement of the contracting piston to the packer as operating fluid is admitted to the chamber on its outer surface through passageway means in the housing. As the piston is moved, its inner surface moves radially inwardly at a greater rate than does its outer surface so that the radial extent of the pressure chamber, and thus the radial extent of the housing, may be substantially smaller than one in which conventional pistons are connected to the packer in the manner previously described, and wherein each increment of inward movement of the outer diameter of the packer requires an equal increment of inward movement of the piston. At the same time, since the means which extends sealably through the wall separating the chamber from the recess need only be of sufficient cross-sectional area to transmit the force of the piston to the packer, well pressure within the recess in the bore of the housing urges the piston outwardly toward expanded position with a small net force.

Preferably, the means for transmitting inward movement of the piston to the packer includes a disc-shaped member of resilient material so that, similarly to the piston, it has an inner surface which is contractible at a greater rate than its outer surface, thereby further reducing the required radial extent of the preventer housing, as compared with that which would be required to accommodate conventional construction.

In the preferred and illustrated embodiments of the invention, passageway means in the housing connect with the chamber on the inner surface of the piston to transmit operating fluid to provide a positive force for expanding the piston, thereby facilitating full expansion of the packer into the housing recess. Preferably, the disc-shaped member is integral with the piston annulus so that it is also positively expanded, and holes are formed in the member to equalize chamber pressure above and below the disc-shaped member, thereby simplifying the arrangement of passageways required to control operating fluid on the inner surface of the piston.

In one embodiment of the invention, the packer is integral with the disc-shaped member so that it too is positively withdrawn with the expanding piston and the disc-shaped member, and holes are formed in the disc-shaped member to equalize recess pressure thereabove and therebelow, whereby well pressure is effective over the entire outer surface of the packer.

In another embodiment of the invention, the packer is separate from the disc-shaped member so that it may be replaced separately therefrom and a ring of resilient material is provided within the disc-shaped member for distributing the force of the piston evenly over the outer surface of the packer. In this embodiment, well pressure is admitted to the recess above the disc-shaped member by means of flutes in the inner surface of the ring.

The housing preferably comprises a cup-shaped body which provides the lower end of the bore through the housing, and has an end wall extending from the bore and an outer wall extending upwardly from the end wall, and a bonnet which provides the upper end of the bore through the housing and is releasably connected to the outer wall of the body and spaced from the end wall of the body to define the top and bottom sides of the recess and pressure chamber. The wall of the housing which divides the packer recess and the pressure chamber from one another comprises annular wall portions extending downwardly from the bonnet and upwardly from the end wall of the body so that the assembly including the packer and piston may be replaced upon removal of the bonnet from the body. Also, in the second mentioned embodiment of the invention, the bonnet includes a cap which is releasably connected to the radially outer portion of the bonnet, so that the packer may be replaced independently of the piston, the disc-shaped member, and the ring.

In both embodiments of the invention, a substantially circular series of rigid inserts is embedded in the resilient material of the packer, the piston and the means for transmitting piston movement to the packer. In the first embodiment, the inserts extend generally from the inner surface of the packer to the outer surface of the piston. In the second embodiment, the inserts embedded in the piston annulus, the disc-shaped member and the ring extend generally from the inner surface of the ring to the outer surface of the piston. Also, the packer annulus and the rigid inserts therein may be identical to those disclosed in the aforementioned U.S. Pat. Nos. 3,572,627 and 3,572,628, thereby enabling the packers to be used interchangeably.

In accordance with a further novel aspect of the invention, the sides of the integral inserts approximate logarithmic spirals having their centers at the axis of the packer, and thus intersecting all radial planes passing through the axis at the same angle. More particularly, the spirals define surfaces of least strain of the rubber with respect to the inserts, the angle of which with respect to a radial plane, thought to be about 45°, may be approximated by one skilled in the art, as described, for example, in prior U.S. Pat. No. 3,572,628.

In the drawings:

FIG. 8 is an exploded, isometric view of the packer and the piston, disc-shaped member and ring assembly of the preventer of FIG. 7, removed from the housing thereof, and broken away in part for purposes of illustration;

FIG. 9 is an isometric view of one of the rigid inserts embedded in the packer of FIG. 8;

FIG. 10 is a partial horizontal sectional view of the piston, disc-shaped member and ring assembly, and the packer of the preventer of FIG. 7, as seen along broken line 10—10 thereof.

Figure 1:
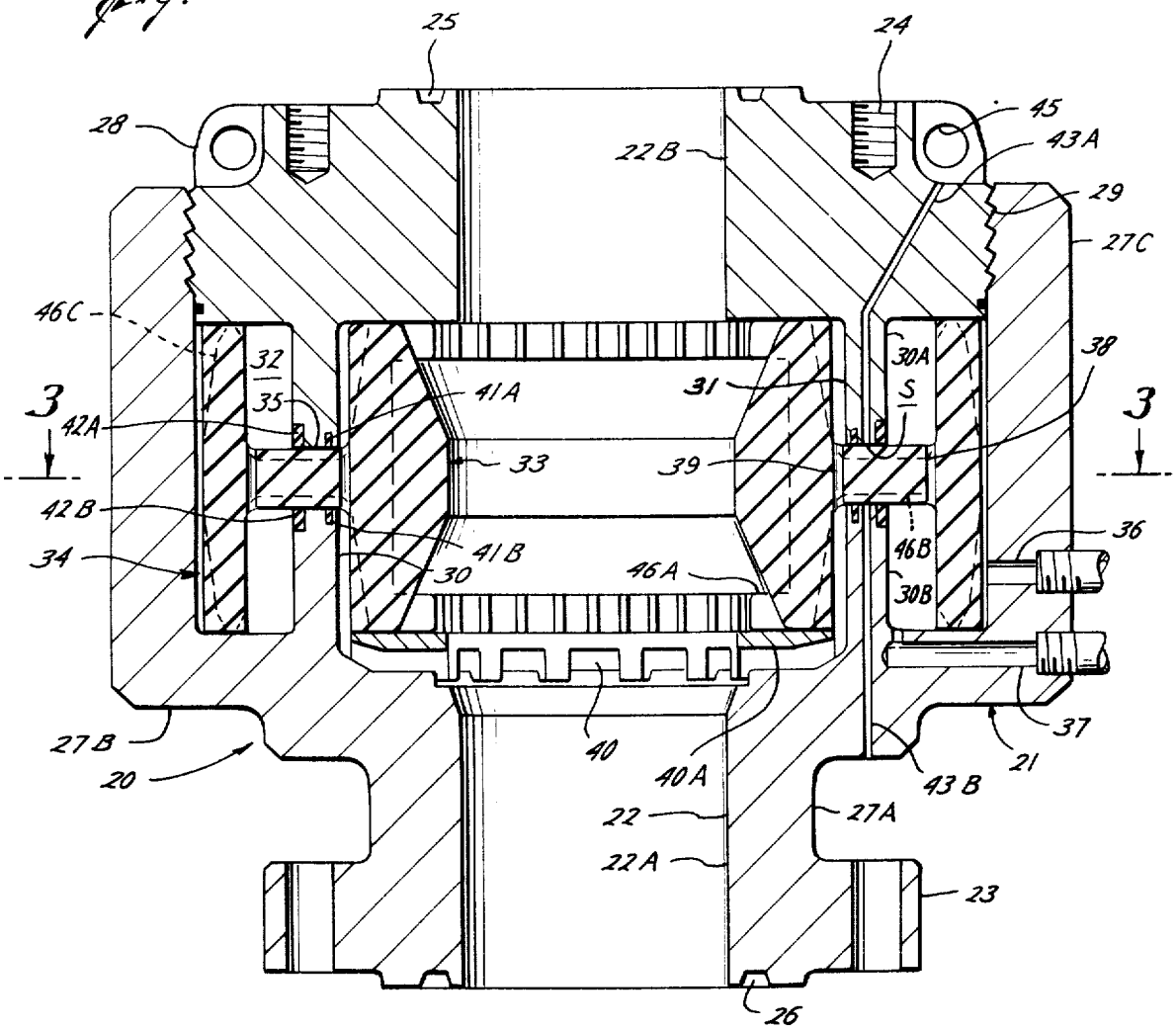
FIG. 1 is a vertical sectional view of a blowout preventer constructed in accordance with the first-mentioned embodiment of the invention, with the packer thereof shown in expanded, fully open position with respect to the bore of the preventer housing.
Figure 2:
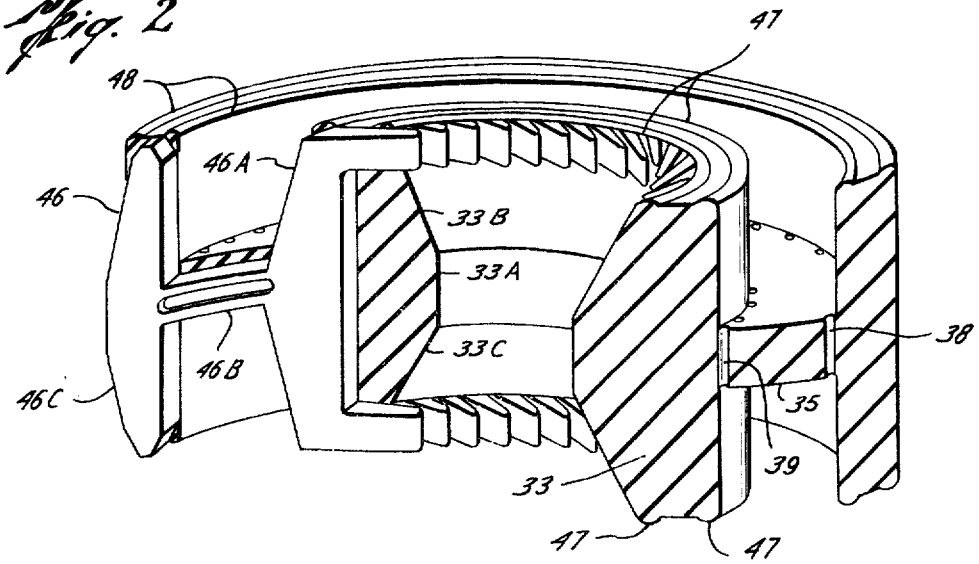
FIG. 2 is an isometric sectional view of the packer, disc-shaped member and piston assembly, removed from the preventer housing of FIG. 1 and broken away for purposes of illustration.

With reference now to the details of the above described drawings, the first embodiment of the preventer, which is indicated in its entirety by reference character 20, includes a housing 21 having a vertical bore 22 therein, and upper and lower ends adapted to be connected to parts of a wellhead (not shown) with its bore 22 forming a continuation of the wellhead bore. Thus, in a typical installation, a flange 23 at the lower end of the housing may be bolted to another preventer of a blowout preventer stack, and holes 24 formed in the upper end may receive studs for connection to the lower end of a riser system extending upwardly to water level. Ring grooves 25 and 26 are formed in the upper and lower ends of the housing about the bore 22 therein to receive seal rings for sealing between the preventer housing and adjacent portions of the wellhead.

The housing 21 includes a body having a lower tubular portion 27A in which the lower end 22A of the housing bore 22 is formed, an end wall 27B extending outwardly from the upper end of tubular portion 27A, and an outer annular wall 27C extending upwardly from end wall 27B. The housing also includes a bonnet 28 having an inner circumference forming the upper end 22B of bore 22 and an outer circumference connected to body wall 27C by threads 29. With the bonnet and body so connected, the bottom side of the bonnet is spaced above the upper side of end wall 27B of the body to define an annular space in the housing radially outwardly of bore 22.

The space is divided by an annular wall 30 extending vertically thereacross into a recess 31 facing the bore 22 on the inner side of the wall and an outer chamber 32 on the inner side of outer body wall 27C. The wall comprises an upper portion 30A extending downwardly from the bonnet, and a lower portion 30B extending upwardly from body end wall 27B and spaced from the end of portion 30A to form an annular slot S in the wall.

Figure 6:
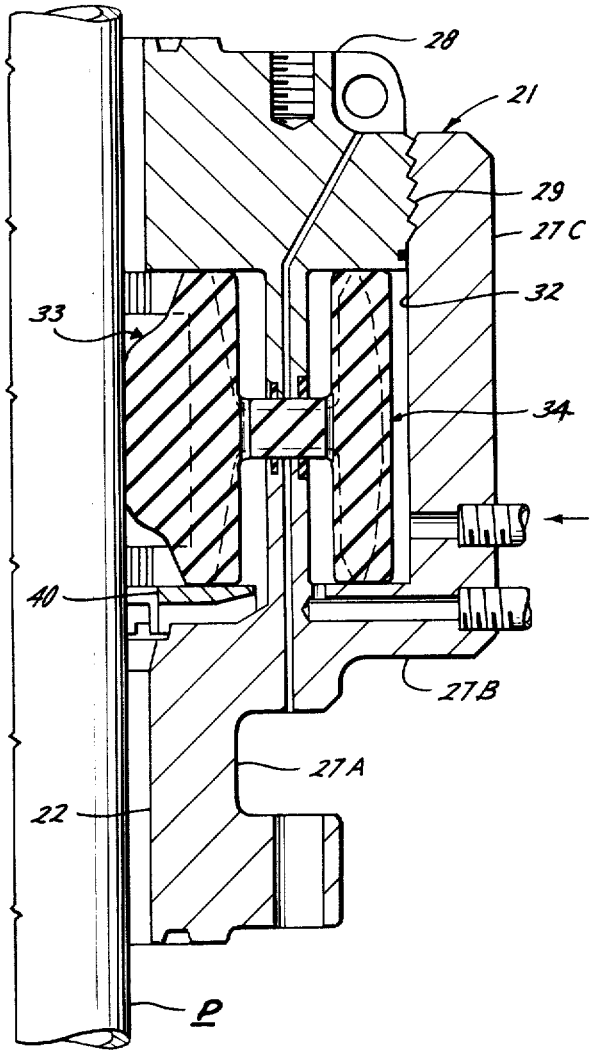
FIG. 6 is a partial vertical sectional view of the preventer, similar to FIG. 1, but with a pipe disposed in the bore of the preventer housing and the packer contracted into sealing engagement with the pipe.

A packer 33 comprising a reinforced annulus of rubber or other resilient material is received within the recess 31 for movement between an outer, expanded position in which its bore is substantially aligned with bore 22 of the preventer housing, as shown in FIG. 1, and an inner, contracted position in which it is adapted to close the bore through the housing. Thus, as shown in FIG. 6, with a pipe P in the housing bore, the packer 33 seals thereabout to close off the annular space between the bore and the pipe. Alternatively, with the bore empty, the packer may be contracted further to seal upon itself, as will be understood in connection with the description to follow of the second embodiment of the invention.

A piston 34 comprising a reinforced annulus of the same material is disposed in the chamber 32 for sealably sliding therein toward and away from the bore of the preventer housing, and a reinforced disc-shaped member 35 of the material extends sealably through slot S and is integrally connected with the packer annulus and piston annulus on its inner and outer surfaces, respectively. Thus, when the piston is forced radially inwardly, in a manner to be described, its contraction will in turn contract the disc-shaped member, which will in turn contract the packer. Moreover, the extent of the contraction of the annular mass made up of the packer, disc-shaped member and piston will be at an increasing rate in a direction from its outer to its inner surface so that, as also previously described, this invention permits the radial extent of the chamber in which the piston is reciprocable to be much less than it would be if the piston and its connection to the packer were of conventional construction.

The piston is urged inwardly by the pressure of operating fluid introduced into chamber 32 on the outer surface of the piston through a passageway 36 in the housing. Also, in accordance with the preferred and illustrated embodiments of the invention, the piston is caused to move outwardly, and the packer and disc-shaped member are therefore positively expanded with it, by operating fluid introduced into the chamber 32 on the inner surface of piston 34 through a passageway 37. Ports 38 are formed through the disc-shaped member 35 adjacent the piston 34 to fluidly connect the chamber 32 above the disc-shaped member with the portion below the disc-shaped member, whereby operating fluid may be introduced through or exhausted from the same passageway 37. Of course, suitable controls (not shown) are provided for controlling the introduction of operating fluid under pressure into one passageway, while permitting its exhaustion from the other passageway.

The radially outer portion of the upper end of the packer annulus is sealably slidable over the lower side of the bonnet within the recess as the packer is moved inwardly to contracted position. The lower end of packer 33 is supported upon and slidable over a bridge 40 which is supported on the top side of the body end wall 27B at the lower end of the recess. Holes 40A are formed in the bridge to permit well pressure in the bore of the preventer housing to have access to the recess behind the packer; and ports 39 are formed in the disc-shaped member adjacent the packer 33 to fluidly connect the recess in the bore of the housing above the disc-shaped member with the recess therebelow. Consequently, when the bore of the packer is sealably engaged with a pipe P, or upon itself when the bore is empty, well pressure will provide a large force which supplements that due to operating fluid in urging the packer into sealing engagement with the pipe. Also, the force with which the piston is moved inwardly to closed position is opposed by only a relatively small force due to well fluid in the bore of the preventer acting over the cross-sectional area of disc-shaped member 35.

Disc-shaped member 35 is sealably slidable within upper seal rings 41A and 42A and lower seal rings 41B and 42B carried within recessed portions of the upper and lower ends, respectively, of the wall portions 30A and 30B forming slot S. A passageway 43A connects the lower end of wall portion 30A intermediate seal rings 41A and 42A with the exterior of the bonnet, and a passageway 43B connects the upper end of the wall portion 30B intermediate seal rings 41B and 42B with the exterior of the body. In this way, leakage of fluid past either the inner or outer seal rings will flow outwardly of the preventer housing, rather than from the chamber into the recess or from the recess into the chamber.

As previously described, and as will be understood from FIGS. 1 and 6, the bonnet 28 may be rotated with respect to the body so as to disconnect threads 29, whereby it may be removed to permit replacement of the packer, piston and connecting disc-shaped member. Lifting of the bonnet may be facilitated by holes 45 about its upper end for receiving hooks from suitable hoisting apparatus.

The resilient material of each of the packer annulus, piston annulus and disc-shaped member is reinforced by a generally circular series of metal inserts 46 bonded thereto and extending in spaced apart relation generally from the inner surface of the packer to the outer surface of the piston. More particularly, each insert includes a portion 46A on its inner end within the packer annulus which is generally "C" shaped and has upper and lower flanges which project radially inwardly of tapering upper and lower portions 33B and 33C above and below mid portion 33A of the front face of the packer annulus, but which terminate radially outwardly of the midportion and thus outwardly of the bore of the housing when the packer is in open position. Each insert also includes a central portion 46B within but of somewhat lesser vertical width than the resilient material of the disc-shaped member, so that the top and bottom surfaces of the disc-shaped member are sealably slidable within the slot S, and a portion 46C at its outer end which is within and of generally the same radial extent and height as the piston annulus.

The upper and lower ends of the packer annulus have lips 47 about their inner and outer circumferences which project vertically beyond the adjacent flange of insert portion 46A. The upper lips effect a sliding seal with the top side of recess 31, while the lower lips permit the packer to be reversed end-for-end. Similar lips 48 on the upper and lower ends of the piston annulus project vertically beyond the adjacent ends of insert portion 46C to effect a sliding seal with chamber 32.

Figure 3:
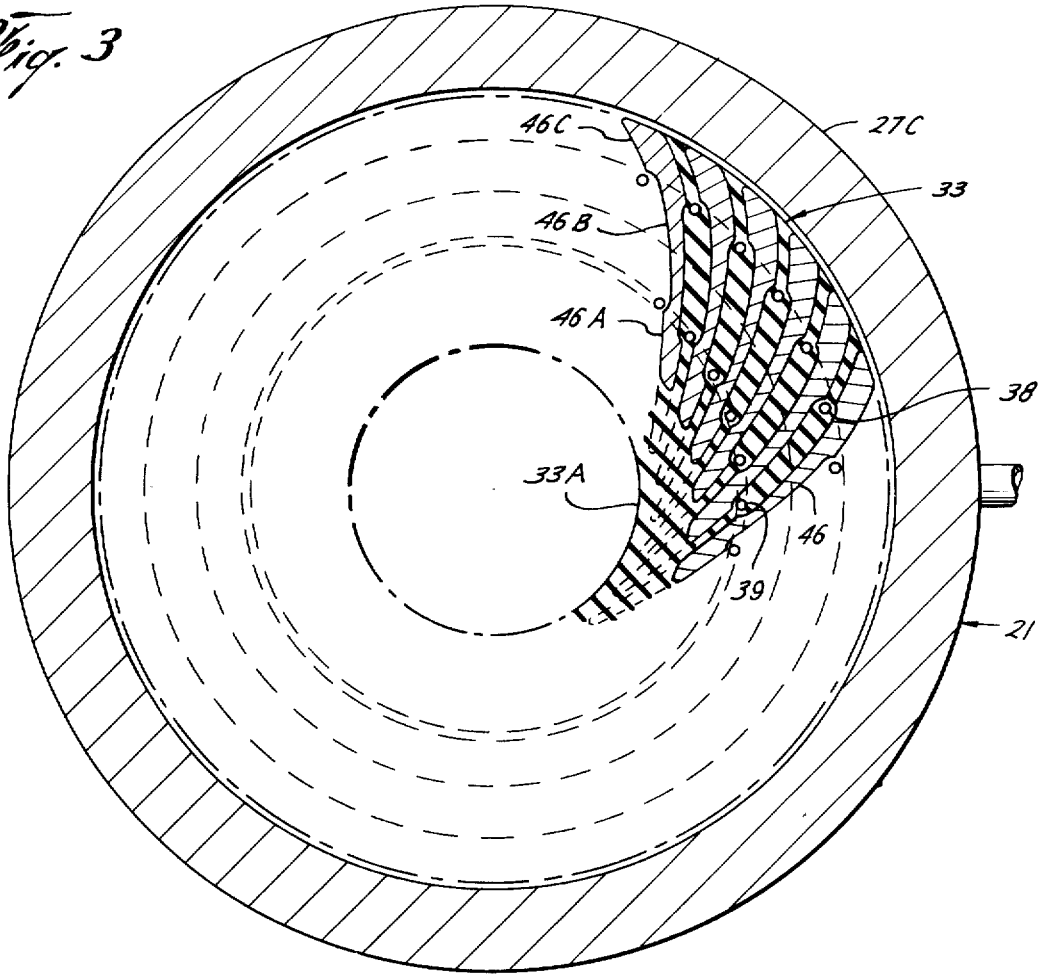
FIG. 3 is a horizontal sectional view of the preventer, as seen along broken line 3—3 of FIG. 1.
Figure 4:
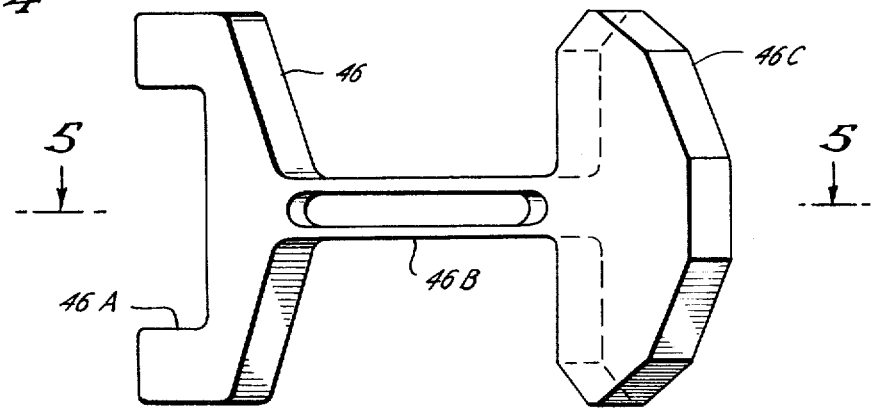
FIG. 4 is an enlarged side view of one of the rigid inserts embedded in the assembly of the preventer of FIGS. 1 to 3.
Figure 5:
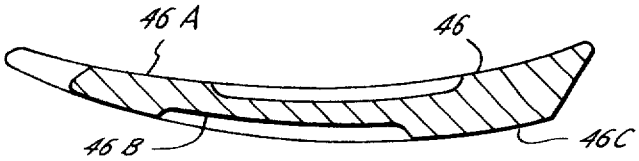
FIG. 5 is a horizontal sectional view of the insert, as seen along broken line 5—5 of FIG. 4.

As shown in FIG. 3, the opposite sides of each insert approximate logarithmic spirals having their centers at the axis of the packer annulus, so that as previously described, they are everywhere disposed at the same angle to any intersecting radial plane. As also previously described, the spirals define surfaces of least strain of the rubber with respect to the inserts, the angle of which with respect to a radial plane, thought to be about 45°, may be approximated by one skilled in the art, as described, for example, in prior U.S. Pat. No. 3,572,628.

The second embodiment of the preventer, which is illustrated in FIGS. 7 to 11, and indicated in its entirety by reference character 50, includes a housing 51 which is in many respects similar to the housing 21 of the preventer 20. It has a vertical bore 52 therethrough and upper and lower ends adapted to be connected in conventional manner, such as that described in connection with the first embodiment, to parts of a wellhead (not shown) with its bore forming a continuation of the wellhead bore. Housing 51 is also similar to housing 21 in that it includes a body having a tubular portion 57A in which the lower end 52A of the housing bore 52 is formed, an end wall 57B extending outwardly from the upper end of tubular portion 57A, and an outer annular wall 57C extending upwardly from the end wall.

The housing also includes a two-piece bonnet 58 having an inner circumference forming the upper end 52B of bore 52 and an outer circumference connected to body wall 57C by threads 59. As in the case of the housing of the preventer 20, with the body and bonnet so connected, the bottom side of the bonnet, the upper side of end wall 57B, and the outer wall 57C of the body define an annular space in the housing radially outwardly of the bore 22. Still further, this annular space is divided by an annular wall 60 which extends vertically across the space into a recess 61 on the inner side of the wall and facing the bore 52, and an outer chamber 62. This dividing wall comprises an upper portion 60A extending downwardly from the bottom side of the bonnet, and a lower portion 60B extending upwardly from the topside of end wall 57B and spaced from the end of portion 60A to provide an annular slot S in the wall.

As in the case of the first-described embodiment, the preventer also includes a packer 63 which comprises a reinforced annulus of rubber or other resilient material received within the recess 61 for movement between an outer expanded position (FIG. 7) in which its bore is substantially aligned with the bore 52 of the preventer housing, and an inner contracted position (FIG. 11) in which it is adapted to seal upon itself and thus to close the bore through the housing with the bore empty. Alternatively, of course, with a pipe received within the housing bore, the packer 63 may be contracted to a lesser extent in order to seal thereabout.

The preventer 51 also includes a piston 64 comprising a reinforced annulus of resilient material disposed in the chamber 62 for sealably sliding radially therein toward and away from the bore of the preventer housing. As compared with the first-described embodiment, however, the packer 63 and piston 64 are separate from one another. However, as in the case of the first-described embodiment, the radially inward movement of piston 64 is transmitted to packer 63 for contracting same by a reinforced disc-shaped member 65 of resilient material which extends sealably through the slot S. In order to better distribute the force of the piston uniformly over the outer side of packer 63, a ring 66 of reinforced resilient material is formed integrally with the inner surface of disc-shaped member 65 and is curved for fitting closely about the packer.

Although the packer and piston are separate, the extent of contraction of the mass of resilient material of the packer, disc-shaped member, ring and piston will be at an increasing rate in a direction from its outer surface to its inner surface. Consequently, as in the case of the first embodiment, the radial extent of the chamber in which the piston is reciprocable may be much less than it would be if the piston and its connection to the packer were of conventional construction.

Figure 7:
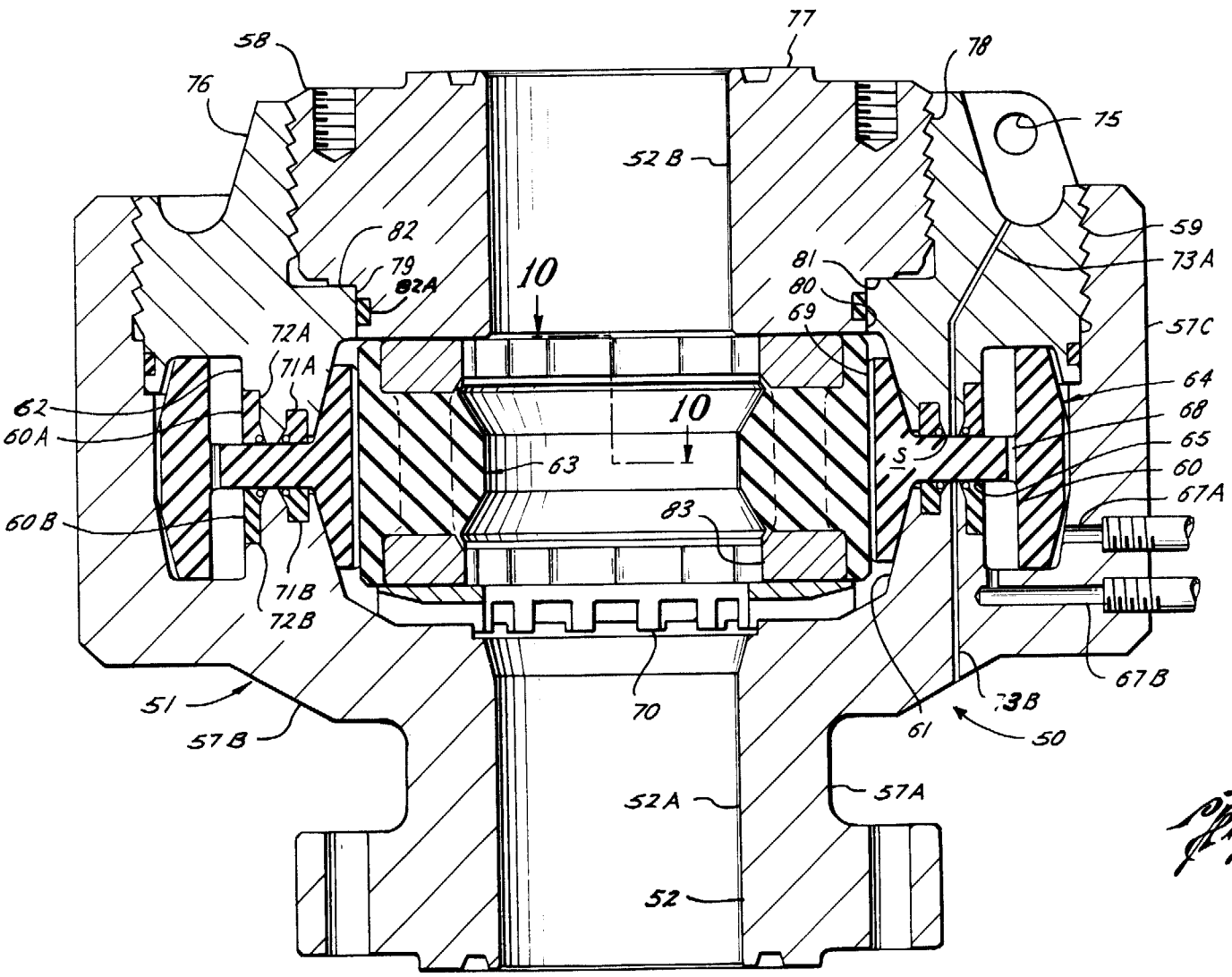
FIG. 7 is a vertical sectional view of a blowout preventer constructed in accordance with the second-mentioned embodiment of the invention, also showing the packer thereof in expanded, fully open position with respect to the bore of the preventer housing.
Figure 11:
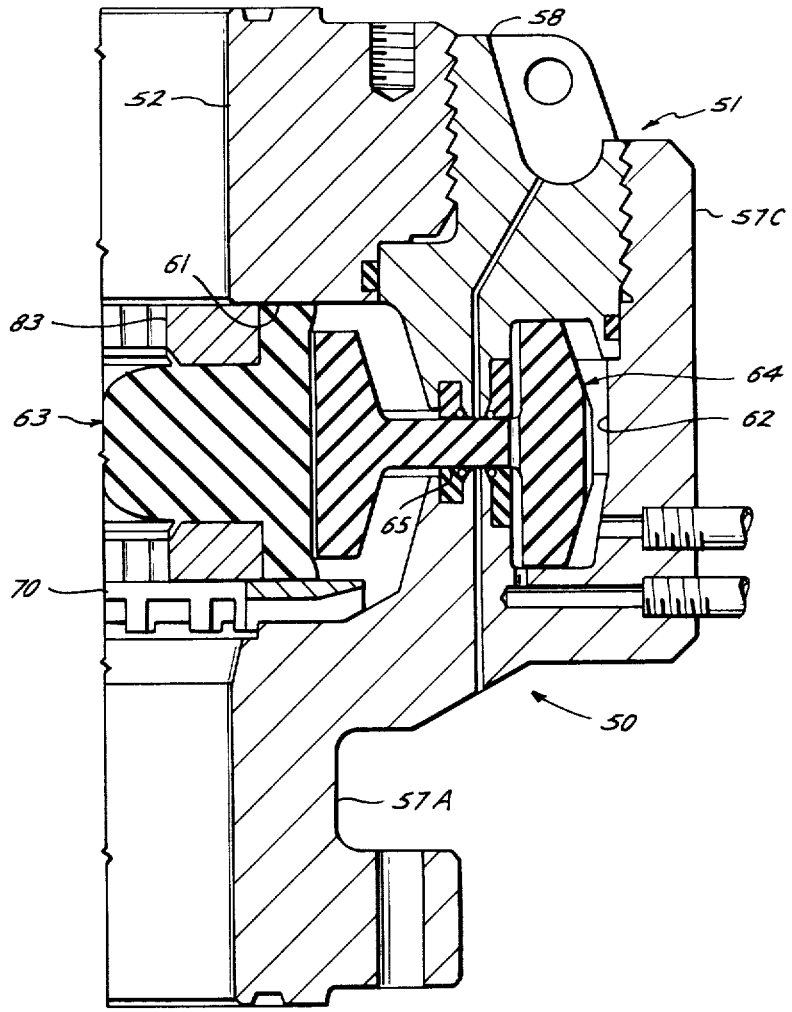
FIG. 11 is a partial vertical sectional view of the preventer, similar to FIG. 7, but with the packer contracted to seal upon itself and thus close the open bore through the preventer body.

Upon outward radial movement of the piston 64, disc-shaped member 65 and ring 66, the packer 63 is free to return to its normally assumed, expanded position, as shown in FIG. 7. Furthermore, in the illustrated embodiment of the invention, disc-shaped member 65 is integral with piston 64, so that it and ring 66 are withdrawn by outward radial movement of piston 64.

Piston 64 is caused to move radially inwardly by means of operating fluid introduced into chamber 62 on the outer surface of the piston through a passageway 67A in the housing. The piston is urged outwardly by means of operating fluid introduced into the chamber on its inner surface through a passageway 67B, ports 68 being formed in disc-shaped member 65 adjacent the inner surface of the piston to connect the portion of chamber 62 below the member 65 with the portion thereof above such member. As mentioned in connection with the first embodiment, suitable controls may be provided for controlling the introduction and exhaustion of operating fluid under pressure into and out of the passageways.

As in the case of the first embodiment, the outer radial portion of the upper end of the packer annulus is sealably slidable over the top side of recess 61, and the lower end of the packer is supported on a bridge 70 supported on the bottom side of the recess and having ports which permit well pressure in the bore of the preventer housing to have access to the rear of the packer. More particularly, the inner surface of ring 66 is provided with vertical flutes 69 to connect the recess in the bore of the housing above the member 65 and ring 66 with the recess therebelow. Thus, with the bore of the packer sealably engaged with the pipe, or upon itself when the packer is empty, and with its upper end sealably engaged with the top side of recess 61, well pressure will have access through the bridge 70 on which the packer is supported for acting across a large area of the outer circumference of the packer, thereby resulting in a large force due to well pressure for assisting operating pressure in maintaining the packer in sealing engagement with the pipe. Also, as in the first embodiment, well pressure acts over only the relatively small cross sectional area of disc-shaped member 65 as the packer is moved inwardly to closed position.

Disc-shaped member 65 is sealably slidable within the upper inner and outer seal rings 71A and 72A carried within recessed portions of the lower end of wall portion 60A, and lower inner and outer seal rings 71B and 72B carried within recessed portions of the upper end of wall portion 60B. Also, a passageway 73A connects the lower end of wall portion 60A intermediate seal rings 71A and 72A with the exterior of the bonnet, while passageway 73B connects the upper end of wall portion 60B intermediate seal rings 71B and 72B with the exterior of the body 51. Thus, as in the first embodiment, fluid leaking past either the inner or outer seal rings will flow outwardly of the preventer housing, rather than from the chamber into the recess, or vice versa.

As in the case of the first embodiment, bonnet 58 may be rotated to disconnect threads 59 and thus permit it to be removed in order to replace the packer, piston, disc-shaped member and ring. Also an eye 75 is provided in the bonnet to facilitate its removal and replacement. However, as distinguished from the first-described embodiment, the bonnet is made in two parts, comprising an outer part 76 having threads 59 formed thereon, and an inner cap 77 having housing bore portion 52B formed therein and threadedly connected at 78 to the outer bonnet portion 76. Removal of the cap from bonnet part 76 permits replacement of the packer 63 separately of the piston, disc-shaped member, and ring, without disturbing the seals enclosing piston 64 in its pressure tight chamber 62.

Thus, as shown, the outer bonnet part 76 has a reduced bore 79 which is at least as large as the expanded packer, and the lower end of the cap has a reduced outer diameter 80 which fits closely within the reduced bore and a shoulder 81 for seating upon a ledge 82 on outer bonnet part 76 to locate the cap in a position in which its bottom said forms the top side of recess 61. A seal ring 82a is carried by the diameter 80 for sealably engaging a bore 79 when the cap is in place.

The separate packer 63 may be identical with the packer shown and described in aforementioned U.S. Pat. Nos. 3,572,627 and 3,572,628. Thus, as best shown in FIG. 8, inserts 83 of metal or other rigid material are bonded to and extend within its annulus of resilient material, each such insert comprising a rib 84 having flanges 85 at its opposite ends. The upper and lower ends of the flanges are generally flush with the ends of the packer annulus, and the outer ends of the flanges are disposed inwardly of the outer surface of the packer annulus to provide a surface 86 adapted to seal against the top side of recess 61 when the packer is contracted for sealing upon itself or about an object in the bore of the housing. As shown, the opposite sides of adjacent inserts slidably engage one another, so that as the annulus is contracted, they are caused to swing into more radially disposed positions, as more fully described in the above-mentioned patents.

In this second embodiment of the invention, each of the piston annulus 64, disc-shaped member 65 and ring 66 is reinforced by a generally circular series of metal inserts 87 bonded thereto and extending in spaced apart relation generally from the inner surface of the ring annulus of resilient material to the outer surface of the piston annulus. Inserts 87 are generally "H"-shaped in cross section to conform generally in elevation with the resilient material in which they are embedded. Thus, as shown in FIG. 8, each such insert includes an inner portion 87A conforming generally with the cross section of the ring annulus, a midportion 87B of somewhat lesser vertical width than the resilient material of the disc-shaped member 65, and an outer portion 87C of generally the same cross section as the piston annulus. Also, lips 88 on the upper and lower ends of the piston annulus project above and below insert portions 87C to affect a sliding seal with chamber 62.

As shown in FIG. 10, and as explained above in connection with the first embodiment, the sides of the inserts approximate logarithmic spirals having their centers at the axis of the packer. More particularly, these sides intersect radial planes at an angle which minimizes strain on their bond to the resilient material of the annulus as the packer is contracted.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An annular blowout preventer, comprising a housing having a vertical bore therethrough, an annular recess in the bore, and an annular chamber about the recess and divided therefrom by a wall, a packer comprising a contractible annulus of resilient material disposed within the recess, a piston comprising a contractible annulus of resilient material sealably slidable within the chamber for movement toward the bore, means extending sealably through the wall for transmitting the inward movement of the piston to the packer to contract it into sealing engagement about an object in the bore or upon itself when the bore is empty, the upper end of the packer being sealably engageable with the top side of the recess as said packer is so contracted, and the outer surface of the packer being fluidly connected with the bore of the housing, and passageway means in the housing connecting with the chamber on the outer surface of the piston to permit operating fluid to be introduced thereto or exhausted therefrom.

2. A blowout preventer of the character defined in claim 1, wherein the packer, the movement transmitting means, and the piston are integral for movement together.

3. A blowout preventer of the character defined in claim 1, wherein the packer is separate from the movement transmitting means and piston.

4. A blowout preventer of the character defined in claim 1, including passageway means in the housing connecting with the chamber on the inner surface of the piston to permit operating fluid to be selectively introduced thereto or exhausted therefrom.

5. A blowout preventer of the character defined in claim 4, wherein the piston and movement transmitting means are integral for movement together.

6. A blowout preventer of the character defined in claim 5, wherein the packer is integral with the movement transmitting means.

7. An annular blowout preventer, comprising a housing having a vertical bore therethrough, an annular recess in the bore, and an annular chamber about the recess, said recess and chamber being divided from one another by a wall having an annular slot therethrough, a packer comprising a contractible annulus of resilient material disposed within the recess, a piston comprising a contractible annulus of resilient material sealably slidable within the chamber for movement toward bore, means including a disc-shaped member of resilient material which is sealably slidable within the slot for transmitting inward movement of the piston to the packer to contract said packer into sealing engagement about an object in the bore of the housing or upon itself when the housing bore is empty, the packer having means on its upper end which is sealably engageable with the top side of the recess as said packer is so contracted, and the outer surface of the packer being fluidly connected with the bore of the housing, and passageway means in the housing connecting with the chamber on the outer surface of the piston to permit operating fluid to be introduced thereto or exhausted therefrom.

8. A blowout preventer of the character defined in claim 7, wherein the packer annulus, the disc-shaped member and the piston annulus are integral for movement together.

9. A blowout preventer of the character defined in claim 8, including means fluidly connecting portions of the recess above and below the disc-shaped member.

10. A blowout preventer of the character defined in claim 9, wherein the connecting means comprises holes in the disc-shaped member.

11. A blowout preventer of the character defined in claim 8, wherein a substantially circular series of rigid inserts is embedded in the piston annulus, the disc-shaped member, and the packer annulus.

12. A blowout preventer of the character defined in claim 7, wherein the movement transmitting means includes a ring on the inner surface of the disc-shaped member, and said ring, said disc-shaped member and said piston annulus are integral with one another and separate from the packer annulus.

13. A blowout preventer of the character defined in claim 12, including means fluidly connecting portions of the recess above and below the disc-shaped member.

14. A blowout preventer of the character defined in claim 13, wherein the connecting means comprises flutes on the inner surface of the ring.

15. A blowout preventer of the character defined in claim 12, wherein a substantially circular series of rigid inserts is embedded in the piston annulus, the disc-shaped member and the ring, and a substantially circular series of rigid inserts is embedded in the packer annulus.

16. A blowout preventer of the character defined in claim 7, including passageway means in the housing connecting with the chamber on the inner surface of the piston to permit operating fluid to be introduced thereto or exhausted therefrom.

17. A blowout preventer of the character defined in claim 16, wherein the piston annulus and the disc-shaped member are integral for movement together.

18. A blowout preventer of the character defined in claim 17, including means fluidly connecting portions of the chamber on the inner surface of the piston above and below the disc-shaped member.

19. A blowout preventer of the character defined in claim 18, wherein the connecting means comprises holes in the disc-shaped member.

20. An annular blowout preventer, comprising a housing having a vertical bore therethrough, and including a body having one end of the bore formed therein, an end wall extending outwardly from the bore, and an outer side wall extending upwardly from the end wall, a bonnet having the other end of the bore formed therein, and means releasably connecting the bonnet to the outer wall of the body with its lower side spaced from the upper side of the body end wall, and a wall extending from the bonnet to the end wall of the body to divide the space therebetween into an annular recess on its inner side and a pressure chamber on its outer side, said dividing wall comprising one portion extending from the bonnet and another portion extending from the end wall of the body and spaced from the one portion to form an annular slot, a packer comprising a contractible annulus of resilient material disposed within the recess, a piston comprising a contractible annulus of resilient material sealably slidable within the chamber for movement toward the bore, means including a disc-shaped member of resilient material sealably slidable within the slot for transmitting inward movement of the piston to the packer to contract said packer into sealing engagement about an object in the bore or upon itself when the bore is empty, the packer having means on its upper end sealably engageable with the top side of the recess as said packer is so contracted, means fluidly connecting the bore of the housing with the recess on the outer surface of the packer, and passageway means in the housing connecting with the chamber on the inner and outer surfaces of the piston to permit operating fluid to be selectively introduced thereto or exhausted therefrom.

21. An annular blowout preventer of the character defined in claim 20, wherein said packer is separate from the disc-shaped member and the piston, and said bonnet comprises a radially outer portion releasably connected to the body and having a bore therethrough, and a cap having the upper end of the housing bore formed therein and being releasably connected to the outer bonnet portion within the bore therethrough.

22. An annular blowout preventer of the character defined in claim 21, wherein the disc-shaped member and the piston are integral to permit them to be replaced as a unit upon disconnection of the bonnet from the body of the housing.

23. An annular blowout preventer of the character defined in claim 20, wherein the packer, the disc-shaped member and the piston are integral to permit them to be replaced as a unit upon disconnection of the bonnet from the body of the housing.

24. An assembly for use in an annular blowout preventer or the like, comprising a piston including an annulus of resilient material, means including a disc-shaped member of resilient material connected to and extending radially inwardly from the inner surface of the piston annulus, and a ring including an annulus of resilient material connected to the inner surface of the disc concentrically of the piston.

25. An assembly of the character defined in claim 24, including a substantially circular series of rigid inserts embedded within the resilient material of the piston annulus, the ring annulus, and the disc-shaped member.

26. An assembly of the character defined in claim 24, wherein holes extend through the assembly to connect portions on opposite sides of the disc-shaped member adjacent the piston.

27. An assembly of the character defined in claim 24, wherein flutes extend from one end to the other of the inner surface of the ring annulus.

28. An assembly of the character defined in claim 27, wherein holes extend through the assembly to connect portions on opposite sides of the disc-shaped member adjacent the piston.

29. An assembly for use in an annular blowout preventer, comprising an annular mass of resilient material, and a substantially circular series of rigid inserts bonded to and arranged in circumferentially spaced-apart relation within the mass to extend generally from the inner to the outer surfaces thereof, the opposite sides of the inserts lying substantially on logarithmic spirals which have their centers on the axis of the annular mass and which define surfaces of least strain of the bond between said resilient material and the sides of said inserts as said annular mass is contracted.

30. An assembly of the character defined in claim 29, wherein the annular mass includes a piston annulus, a disc-shaped member extending inwardly from the inner surface of the piston annulus, and a packer annulus on the inner surface of the disc-shaped member.

31. An assembly of the character defined in claim 29, wherein the annular mass includes a piston annulus, a disc-shaped member extending inwardly from the inner surface of the piston annulus, and a ring annulus on the inner surface of the disc-shaped member.

32. An assembly for use in an annular blowout preventer or the like, comprising a packer including an annulus of resilient material, a piston including an annulus of resilient material disposed concentrically about the packer, and means including a disc-shaped member of resilient material extending radially between the packer and annulus for transmitting a radially inwardly contracting force to the packer, each annulus and the disc-shaped member having circumferentially separated rigid reinforcing means embedded within the resilient material thereof, and the rigid reinforcing means within the resilient material of each annulus extending from substantially one end to the other thereof.

33. An assembly of the character defined in claim 32, wherein the resilient material of the disc-shaped member is integrally connected to the resilient material of the packer annulus and piston annulus.

34. An assembly of the character defined in claim 33, wherein the rigid reinforcing means comprises a substantially circular series of rigid inserts embedded within the resilient material of the packer annulus, the piston annulus, and the disc-shaped member.

35. An assembly of the character defined in claim 33, wherein holes extend through the assembly to connect portions on opposite side of the disc-shaped member with one another adjacent the packer.

36. An assembly of the character defined in claim 33, wherein holes extend through the assembly to connect portions on opposite sides of the disc-shaped member with one another adjacent the piston.

37. An assembly of the character defined in claim 36, wherein holes extend through the assembly to connect portions on opposite sides of the disc-shaped member with one another adjacent the packer.

* * * * *